US010099752B2

(12) United States Patent
Roodenburg et al.

(10) Patent No.: US 10,099,752 B2
(45) Date of Patent: Oct. 16, 2018

(54) OFFSHORE DRILLING SYSTEM, VESSEL AND METHOD

(71) Applicant: ITREC B.V., Schiedam (NL)

(72) Inventors: Joop Roodenburg, Schiedam (NL); Diederick Bernardus Wijning, Schiedam (NL); Pieter Dirk Melis Van Duivendijk, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/520,952

(22) PCT Filed: Oct. 22, 2015

(86) PCT No.: PCT/EP2015/074500
§ 371 (c)(1),
(2) Date: Apr. 21, 2017

(87) PCT Pub. No.: WO2016/062812
PCT Pub. Date: Apr. 28, 2016

(65) Prior Publication Data

US 2017/0341717 A1 Nov. 30, 2017

(30) Foreign Application Priority Data

Oct. 24, 2014 (NL) ..... 2013680

(51) Int. Cl.
*E21B 7/12* (2006.01)
*B63B 35/44* (2006.01)
(Continued)

(52) U.S. Cl.
CPC ..... *B63B 35/4413* (2013.01); *E21B 7/12* (2013.01); *E21B 19/006* (2013.01); *B63B 2001/044* (2013.01); *E21B 7/185* (2013.01)

(58) Field of Classification Search
None
See application file for complete search history.

(56) References Cited

U.S. PATENT DOCUMENTS 3,681,928 A 8/1972 Vincken et al.
6,343,893 B1 2/2002 Gleditsch
(Continued)

FOREIGN PATENT DOCUMENTS

GB 1 258 832 A 12/1971
GB 2 164 686 A 3/1986
(Continued)

*Primary Examiner* — Matthew R Buck
*Assistant Examiner* — Douglas S Wood
(74) *Attorney, Agent, or Firm* — Birch, Stewart, Kolasch & Birch, LLP

(57) ABSTRACT

An offshore drilling system includes a drilling tower, a tubular string hoisting device with a crown block and a travelling block suspended from the crown block in a multiple fall arrangement. A heave compensation system is adapted to provide heave compensation of the travelling block. The heave compensation system includes a hydraulic sheave compensator. The system further includes a mobile working deck which is movable with respect to the drilling tower within a motion range including a heave compensation motion range. The heave compensation system is further adapted to provide heave compensation of the mobile working deck by a hydraulic deck compensator, which is hydraulically connected via a hydraulic conduit to the hydraulic sheave compensator, such that in operation the deck compensator moves synchronously with the sheave compensator of the heave compensation system.

20 Claims, 10 Drawing Sheets

(51) Int. Cl.

| | |
|---|---|
| ***E21B 19/00*** | (2006.01) |
| *B66D 1/00* | (2006.01) |
| *B66D 1/48* | (2006.01) |
| *E21B 19/09* | (2006.01) |
| *B63B 23/02* | (2006.01) |
| *B63B 23/70* | (2006.01) |
| *B63B 1/04* | (2006.01) |
| *E21B 7/18* | (2006.01) |

(56) References Cited

U.S. PATENT DOCUMENTS

| | | | | |
|---|---|---|---|---|
| 6,595,494 | B1 | 7/2003 | Roodenburg et al. | |
| 9,266,586 | B2 * | 2/2016 | Roodenburg | E21B 19/09 |
| 2017/0074057 | A1 * | 3/2017 | Roodenburg | B63B 35/4413 |

FOREIGN PATENT DOCUMENTS

| | | | |
|---|---|---|---|
| GB | 2 354 028 | A | 3/2001 |
| WO | WO 2004/013452 | A1 | 2/2004 |
| WO | WO 2010/071444 | A1 | 6/2010 |
| WO | WO 2013/169099 | A2 | 11/2013 |

* cited by examiner

OFFSHORE DRILLING SYSTEM, VESSEL AND METHOD

The present invention relates to an offshore drilling system for performing subsea wellbore related activities, e.g. drilling a subsea wellbore, comprising a floating drilling vessel that is subjected to heave motion due to waves.

The present invention also relates to a floating drilling vessel adapted for use in the system and to methods that are performed using the system.

In the art, e.g. as marketed by the present applicant, offshore drilling vessels are known that comprise:

- a floating hull subjected to heave motion, the hull comprising a moonpool,
- a drilling tower at or near the moonpool,
- a tubular string hoisting device, the tubular string for example being a drill string,
- hoisting device comprising:
- a main hoisting winch and main cable connected to said winch,
- a crown block and a travelling block suspended from said crown block in a multiple fall arrangement of said main cable, which travelling block is adapted to suspend a tubular sting, e.g. a drill string, therefrom along a firing line, e.g., with an intermediate topdrive adapted to provide a rotary drive for a drill string,
- a heave compensation system adapted to provide heave compensation of the travelling block, the heave compensation system comprising a main cable heave compensation sheave in the path between said main hoisting winch and the travelling block, a passive and/or active heave motion compensator device connected to said main cable heave compensation cable sheave,
- a riser tensioning system adapted to connect to a riser extending along the firing line between the subsea wellbore and the vessel, the riser tensioning system comprising a tension ring and tensioner members connected to said tension ring.

In a known embodiment, e.g. as disclosed in U.S. Pat. No. 6,595,494, a travelling block heave compensation system comprises two main cable heave compensation sheaves, each one in the path between one of the said main hoisting winches and the travelling block. Each of these sheaves is mounted on the rod of a compensator cylinder, with these cylinder connected, possibly via an intermediate hydraulic/gas separator cylinder, to a gas buffer as is known in the art.

In the offshore drilling field it is also known to make use of a slip joint, also referred to as telescopic joint. Commonly the slip joint has a lower outer slip joint barrel and an upper inner slip joint barrel, wherein the lower outer barrel is adapted to be connected to a fixed length section of the riser extending to the subsea wellbore to the riser. In known embodiments the slip joint is provided with a locking mechanism, e.g. with hydraulically activated dogs, which is adapted to lock the slip joint in a collapsed position. Known slip joints provided a higher pressure rating in the collapsed and locked position than in the dynamic stroking mode. For example slip joints are known to have one or more metal-to-metal high pressure seals that are operative in the collapsed and locked position, whereas in dynamic mode a hydraulically activated low pressure seal or seals are operative.

In the offshore drilling field it is known for the tension ring of the riser tensioning system to be connected to the outer barrel of the slip joint. Known tensioning systems include a wireline tensioning systems, wherein wire lines extend from the tensioning ring to tensioners on-board the vessel. Also known are direct-acting riser tensioning systems, wherein multiple cylinder units directly engage on the tension ring.

WO2010/071444 discloses a floating arrangement with a riser tensioning system. The riser tensioning system is provided to maintain an approximately constant tension in the riser when the floating arrangement moves in the water. The tensioning system is here indicated as a first set of heave compensating devices. The floating arrangement further comprises a work deck which is arranged in an opening in a drill floor. The work deck can move relative to the drill floor by a second set of heave-compensating devices to keep the work deck at an approximately constant distance from the seabed.

In the field of drilling so-called closed circulation methods become increasingly attractive, e.g. in view of improved control of pressure within the wellbore, e.g. during drilling. To this end a rotating control device, RCD, is arranged, commonly above the slip joint, to closed of the annulus between an upper riser section and the tubular string extending through the riser. One or more flowhead members below the RCD, or integrated therewith, allow for connection of one or more hoses so that annular fluid flow, e.g. return mud, can be transferred to the vessel. Due to the sealing of the annulus by the RCD control of fluid pressure in the annulus is possible, e.g. in view of techniques such as Managed Pressure Drilling.

It is an object of the invention to provide an improved system. For example the invention aims to provide for improved wellbore pressure control during drilling of the subsea wellbore. Another aim of the invention is to improve the practical use of equipment as addressed above, e.g. in view of drilling project efficiency, efforts of drilling personnel, etc.

The present invention provides an offshore drilling system for performing subsea wellbore related activities, e.g. drilling a subsea wellbore.

The drilling system comprises a drilling tower having a top and a base. The drilling tower is to be positioned at or near a moon pool of a floating body, e.g. a drilling vessel or platform.

The drilling system comprises a riser tensioning system adapted to connect a riser extending along the firing line between the subsea wellbore and the floating body. Particularly, the riser tensioning system comprises a tension ring and tension members connected to said tension ring.

The drilling system comprises a tubular string main hoisting device, the tubular string for example being a drill string. The main hoisting device comprises a main hoisting winch and main cable connected to said winch, a crown block and a travelling block suspended from said crown block in a multiple fall arrangement of said main cable. The travelling block is adapted to suspend a tubular string, e.g. a drill string, therefrom along a firing line, e.g. with an intermediate topdrive adapted to provide a rotary drive for a drill string.

The drilling system further comprises a heave compensation system adapted to provide heave compensation of the travelling block. The heave compensation system comprises a main cable heave compensation sheave in the path between said main hoisting winch and the travelling block. The heave compensation system comprises a hydraulic sheave compensator connected to said main cable heave compensation sheave.

The drilling system further comprises a mobile working deck which is movable with respect to the drilling tower along the firing line within a motion range including a heave compensation motion range.

According to the invention, the heave compensation system is further adapted to provide heave compensation of the mobile working deck. The heave compensation system further comprises a hydraulic deck compensator, which deck compensator is connected to the floating body and to the mobile working deck to provide a heave compensated motion of the deck relative to the floating body. The deck compensator is hydraulically connected via a hydraulic conduit to the hydraulic sheave compensator of the heave compensation system, such that in operation the deck compensator moves synchronously with the sheave compensator of the heave compensation system.

Advantageously, the heave compensation system according to the invention provides both a heave compensation of the travelling block and the mobile working deck. Advantageously, a single actuator for an active control of the heave compensation system or a single buffer for a passive control of the heave compensation system may be arranged to control both the main hoisting device and the mobile working deck.

The system according to the invention allows to obtain a synchronous heave compensated motion of the working deck and the travelling block in a simple manner with high accuracy and reliability.

By operation of the main hoisting winch of the hoisting device, the travelling block can be positioned independently from a position of the working deck. During a drilling process, this is in particular advantageous in a step of connecting or disconnecting a pipe length by screwing to a drill string, because the synchronous heave compensation motion obtained from the integrated heave motion system which may prevent damage to a threaded end of the pipe length.

The hydraulic connection of the deck compensator and the sheave compensator provides a fluid communication in between the compensators of the heave compensation system which results in a substantially same hydraulic pressure at both compensators. Fluctuations in hydraulic pressure caused by the heave motion of the floating body will act on both compensators, such that both compensators will move substantially synchronously.

Preferably, the deck compensator is fully arranged below the working deck. The arrangement allows to provide synchronous heave compensation motion of the travelling block and the working deck, whilst keeping the working deck floor fully accessible. This e.g. allows for pipe racking operations to be performed between the firing line and a tubular storage rack without any hindrance. For example, this is a favourable solution compared to the solutions disclosed in WO2013/169099. In a simple embodiments described therein the working deck is suspended directly by rods, cables, or chains from the travelling block so that the heave compensation motion follows thereof. Well entry equipment, e.g. is described the coiled tubing injector head unit, which is placed on the working deck. Whilst for such an operation any direct suspension device between the working deck and travelling block may not be problematic, such a suspension device does limit access to the firing line, and may therefore limit the operational capability of a vessel in view of the variety of activities to be performed.

In an embodiment of the system according to the invention, the hydraulic deck compensator comprises at least one double acting hydraulic cylinder having a cylinder housing, a piston and a piston rod which piston subdivides the cylinder housing in a first cylinder chamber at a piston side and a second cylinder chamber at an opposite rod side of the piston. The piston has a piston area in the first chamber at the piston side to be pressurised to extend the piston rod out of the cylinder housing and a ring-shaped piston area in the second chamber at the rod side to be pressurised to return the piston rod into the cylinder housing. The hydraulic cylinder further comprises a valve controlled by-pass channel which allows to interconnect the first and second cylinder chamber. The valve-controlled interconnection in between the first and second chamber of the hydraulic cylinder allows an adjustment of an effective piston area. A closed bypass channel will result in an effective piston area which is equal to the piston area in the first chamber. When the bypass channel is open, the effective area to extend the piston rod will be reduced. An open bypass channel in between first and second chamber will result in an effective piston area which is equal to the piston area in the first chamber minus the ring-shaped piston area in the second chamber.

The effective piston area is configured in accordance with a multiple fall arrangement of the hoisting device. A ratio in adjustment of the effective piston area of the deck compensator equals with a ratio in adjustment of a multiple fall arrangement of the hoisting device. The effective piston area at the piston side is in case of a closed by-pass channel a factor, e.g. a factor 1.5, larger than an effective piston area in case of an open by-pass channel. Said factor is configured in accordance with an available multiple fall arrangement, e.g. 12-8 fall arrangement, of the hoisting device which is coupled in heave motion. Said multiple fall arrangement hoisting device comprises one or more main cable sheaves connected to the travelling block which have an individual lower latching device allowing to connect and disconnect the individual sheave to and from the travelling block to adjust the fall arrangement of the hoisting device by the same factor.

In a further embodiment of the system according to the invention, the one or more sheaves also have an upper latching device allowing to latch the sheave to the crown block if the sheave is disconnected from the travelling block.

In an embodiment of the system according to the invention, the by-pass channel is connected to an accumulator for accumulating a volume of hydraulic liquid. Preferably, the accumulator is valve controlled by an accumulator valve, such that the accumulator can be closed in case that the bypass channel is open and in that the accumulator can be opened in case that the bypass channel is closed. The accumulator is fluidly connected to the bypass channel at a position in between the second chamber of the hydraulic cylinder of the deck compensator and the accumulator valve. The accumulator allows an accumulation of hydraulic liquid from the second chamber in case that the bypass channel is closed. In case that the bypass channel is open, the hydraulic liquid can flow out of the second chamber to the first chamber via the bypass channel, such that the accumulator can be closed.

In an embodiment of the system according to the invention, the hydraulic deck compensator comprises a pair of hydraulic cylinders which are positioned at opposite sides of the firing line. Preferably, the hydraulic cylinders are positioned in a vertical plane comprising the firing line. The pair of hydraulic cylinders are spaced apart to allow for a passage of the riser section in the firing line and between said pair of hydraulic cylinders.

In an embodiment of the system according to the invention, the hydraulic deck compensator is arranged in its stationary operative position at a level below the working deck, e.g. below the working deck when in its lower stationary position.

In an embodiment of the system according to the invention, the motion range includes a lower stationary position and wherein the heave compensation motion range lies higher than said lower stationary position. Advantageously, the system allows a drilling technique of managed pressure drilling.

In an embodiment of the system according to invention, the first hydraulic compensator is connected to an active actuator to obtain an active control of the heave compensation system. Instead of a passive control of the heave compensation system including for example a gas buffer, an active control is obtained by using the active actuator. Advantageously, the active control may contribute to a quicker responding and a more accurate heave compensation system.

In an embodiment the tower is a mast having a top and a base, the base adjacent the moonpool, wherein one or more hydraulic cylinders of the heave motion compensator system is arranged within said mast, e.g. in vertical orientation therein. Preferably, the hydraulic sheave compensator of the heave compensation system is arranged within said drilling tower e.g. in a vertical orientation therein.

In an embodiment of the system according to the invention, the main hoisting device comprises a first main hoisting winch and a second main hoisting winch, wherein the main cable is connected at either end thereof to a respective one of the first and second main hoisting winches. This e.g. allows for redundancy of the winches in the main hoisting device.

In an embodiment of the system according to the invention, the first heave motion compensation system comprises a first main cable heave compensation sheave in the path between the first main hoisting winch and the travelling block, a first hydraulic compensator connected to said first main cable heave compensation sheave, and a second main cable heave compensation sheave in the path between the second main hoisting winch and a travelling block, a second hydraulic compensator being connected to said second main cable heave compensation sheave.

In an embodiment each heave motion compensator device comprise a hydraulic cylinder having a piston rod, the main cable heave compensation sheave being connected to said piston rod. The hydraulic cylinder is connected to a hydraulic/gas separator cylinder, one chamber thereof being connected to a gas buffer as is known in the art.

For example the compensator cylinder has a stroke between 5 and 15 meters, e.g. of 6 meters.

In an embodiment a two connector cable winches are provided, each connected to an end of the connector cable. This arrangement provides for redundancy of said connector cable winches.

In an embodiment of the system according to the invention, the system further comprises a riser tensioning system adapted to connect a riser extending along the firing line between the subsea wellbore and the floating body, wherein the riser tensioning system comprises a tension ring and tension members connected to said tension ring.

In an embodiment the system is provided with a riser wireline tensioning system with one or more wirelines that depend from respective wireline sheaves and connect to the tension ring that is connectable to the outer barrel of the slip joint. Or the riser tensioner may be a direct-acting telescopic riser tensioner with multiple telescopic tensioner legs that connect to the tension ring.

In an embodiment of the system according to invention, the system further comprises a piper racker system provided with a heave motion synchronisation system adapted to bring a drill pipe length retrieved from a drill pipe storage rack into a vertical relative motion synchronous with a relative motion of the upper end of the riser, e.g. of the working deck resting thereon, thereby allowing to interconnect the drill pipe to a drill pipe string suspended from a slip tool.

In an embodiment of the system according to the invention, the system further comprises a slip joint. The slip joint includes an outer barrel and an inner barrel, wherein the outer barrel is adapted to be connected to a fixed length section of a riser which extends to the subsea wellbore. The slip joint is provided with a locking mechanism which is adapted to lock the slip joint in a collapsed position. Preferably, the tension ring of the riser tensioning system is configured to be connected to the outer barrel of the slip joint.

In an embodiment of the system according to the invention, the system further comprises an upper riser section. The upper riser section is mounted on the slip joint, in particular on the inner barrel of the slip joint. The upper riser section extends upwards from the slip joint. In particular, the upper riser section extends above the lower stationary position of the working deck. Preferably, the upper riser section extends to the heave compensation motion range.

In an embodiment of the system according to the invention, the working deck is adapted to rest onto the upper riser section. Preferably with said upper riser section being the sole vertical loads support of the working deck.

In an embodiment of the system according to the invention, the system further comprises a rotating control device (RCD) for closing off and annulus between an upper riser section and a tubular string extending through the riser. The RCD includes at least one flowhead member to allow a connection of at least one hose for transferring an annular fluid flow to the floating body. Advantageously, the RCD allows a method of managed pressure drilling. Preferably, the RCD is positioned above the slip joint. Preferably, the RCD is positioned below the working deck.

In the inventive system, with the slip joint un-locked, subsea well related operations can be carried out with the slip joint absorbing the heave motion of the vessel. This is the preferably done from a drill floor working deck held in stationary position above the moonpool.

The invention system—with the slip joint locked—for example allows for highly accurate heave compensation in case an RCD seals the annulus between the riser and the drill string or other tubular string. As in this situation, with the locked slip joint and the RCD, the fluid volume within the riser effectively has become a fixed volume any heave motion, or residual heave motion, will result in major pressure variations of fluid in this fixed volume. The present inventive system allows to maintain such pressure variations, if any, to a limited and acceptable level.

As will be explained in more detail below it is envisaged, in an embodiment, with the slip-joint locked and an RCD in place, drilling is performed by means of a topdrive attached to the travelling block and by addition of drill pipes to the drill string that extends through the suspended riser. The working deck is then provided with a drill string slip tool adapted to support the drill string as a new drill pipe is attached to the drill string, or when a drill string is removed during tripping. During this operation both the travelling block and the working deck are in heave compensation mode relative to the hull of the vessel. Due to the accuracy provided by the inventive system, even with the fluid volume in the riser being constant due to the RCD, the pressure variations within the wellbore are limited thus enhancing drilling techniques like Managed Pressure Drilling. The managed pressure drilling activity can then be performed without the pressure limitation of the otherwise dynamically stroking slip joint.

In an embodiment the system is provided with a vertically mobile working deck that is vertically mobile within a motion range including a lower stationary position, wherein the working deck is used as stationary drill floor deck with the slip joint unlocked, and the motion range further including a heave compensation motion range that lies higher than said lower stationary position. In this heave compensation motion range the working deck can perform heave compensation motion relative to the hull of the vessel.

Preferably the working deck is adapted to rest onto the upper riser section, preferably with said upper riser section being the sole vertical loads support of the working deck. The latter embodiment is advantageous as optimal access to the upper riser section is available, e.g. for flowlines or other (electrical) lines leading to any equipment in said upper riser sections, for mudline(s), etc. For example such equipment can be one or more of an RCD, a diverter, a BOP, etc.

Preferably the system is provided with a drillers cabin deck and a drillers cabin thereon, with the lower stationary position of the working deck being at said drillers cabin deck level. This e.g. allows for the drilling personnel in said cabin to have a direct view on equipment in the upper riser section and lines attached thereto when operated with the slip joint collapsed and locked, and with the working deck in heave motion in said elevated heave motion compensation range.

The inventive system can also be embodied such that the working deck, in heave motion compensation mode, does not rest with its weight and, if present, load thereon on or entirely on the upper riser section. Then the working deck is provided with a downward depending deck frame. Such a deck frame may e.g. include vertical braces, a lattice work, etc.

As is preferred the working deck has an opening therein that is aligned with the firing line, the opening being dimensioned to at least allow for passage of the tubular string that extends into and through the riser.

As is preferred the working deck is provided with a tubular string suspension device, e.g. a device known as a slip in the drilling field.

The working deck may be provided with a rotary table.

In an embodiment of the system according to the invention, the working deck is provided with a riser connector to secure the working deck to a riser extending in the firing line, e.g. to the top end of the riser or to an inner barrel of a slip joint in the riser.

The arrangement allows to provide synchronous heave compensation motion of the travelling block and of the working deck, whilst keeping the working deck floor fully accessible. This e.g. allows for piperacking operations to be performed between the firing line and a tubular storage rack without any hindrance. For example, this is a favorable solution compared to the solutions disclosed in WO 2013/169099. In simple embodiment described therein the working deck is suspended directly by rods, cables, or chains from the travelling block so that is follows the heave compensation motion thereof. The WO2013/169099 document describes that well entry equipment, e.g. a coiled tubing injector head unit, is placed on the working deck. Whilst for such an operation any direct suspension device between the working deck and travelling block may not be problematic, such a suspension device does limit access to the firing line, and may therefor limit the operational capability of the vessel in view of the variety of activities to be performed.

The inventive systems allow to obtain synchronous heave compensating motion of the working deck and the travelling block in a simple manner with high accuracy and reliability.

By virtue of the connection cable winch one can position the working deck independent from the travelling block position, e.g. with the provision of choosing an upper riser section of the correct length, e.g. by addition of small length riser elements.

By suitable control of the connector cable winch it may be possible to bring the working deck in a stationary position relative to the hull, e.g. with the slip joint unlocked, e.g. in a lowermost parking position, possibly the working deck being locked in said parking position, whereas the travelling block may be continued to operate in heave compensation mode.

The inventive system may be embodied so that the heave motion system is adapted to support a vertical load whilst in heave compensation motion of at least 300 metric tonnes, e.g. between 400 and 800 metric tonnes.

In an embodiment the vessel is provided with a drilling pipes storage rack, e.g. a carousel, adapted for storage of drill pipes in vertical orientation therein, the drill pipe storage rack being mounted on the hull so as to be subjected to heave motion along with the hull. The vessel is further provided with a pipe racker system that is adapted to move a pipe section between the drill pipe storage rack and a position in the firing line between the working deck and the travelling block. A drill string slip is provided that supports the suspended drill string within the riser when the drill string is disconnected from the travelling block, e.g. from the topdrive, in view of the connection of a new drill pipe to the suspended drill string.

This pipe racker system is provided with a heave motion synchronization system that is adapted to bring a drill pipe retrieved from the drill pipe storage rack into a vertical motion synchronous with the heave motion of the suspended drill string relative to the hull of the vessel in the collapsed and locked position of the slip joint. If a vertically mobile working deck is provided, it is deemed advantageous if the slip device is mounted on or in said working deck, with the deck being in heave motion, e.g. as it rests on the top end of the riser.

The above pipe racker system thus allows for drilling operations to be performed with the top end of the riser and the drill string slip device, possibly also a working deck supporting the slip device, in heave motion relative to the hull of the vessel. This allows said drilling operation to be performed with the slip joint locked, and e.g. allows for the use of an RCD device to seal the annulus and therefor obtain a controlled pressure within the riser, e.g. in view of Managed Pressure Drilling.

In embodiment the vessel is provided with an iron roughneck device arranged on the working deck, e.g. on the vertically mobile working deck. This e.g. allows the use of the iron roughneck deck for make-up or break-up of the threaded connection between drill pipes or other tubular bodies.

In an alternative embodiment the vessel has an iron roughneck device that is not mounted on the working deck, but is instead independently supported from the hull of the vessel, e.g. vertically mobile along a rail mounted to the tower by means of a vertical drive. The iron roughneck device is then provided with a heave motion vertical drive adapted to move the iron roughneck device in heave motion in synchronicity with the heave motion of the suspended drill string, so that the iron roughneck device can operate whilst in heave motion.

The heave motion compensating pipe racker system can be used to move drill pipes, e.g. double or triple pipe stands, between the drill pipe storage rack and the firing line so as to connect a new drill pipe to the pipe string held by the slip device whilst in heave motion. It is envisaged that this may be of great value for managed pressure drilling wherein highly accurate control of borehole pressure is desired.

Further, the invention relates to a floating body, in particular a drilling vessel, more in particular a vessel having a floating hull with a moonpool.

Preferably, the vessel according to the invention is a mono-hull vessel with the moonpool extending through the design waterline of the vessel. In another embodiment, for example, the vessel is a semi-submersible vessel having submergible pontoons (possibly an annular pontoon) with columns thereon that support an above-waterline deck box structure. The moonpool may then be arranged in the deck box structure.

As will be appreciated the inventive vessel is most advantageous when the vessel has onboard a slip joint having a lower outer slip joint barrel and an upper inner slip joint barrel, wherein the outer barrel is adapted to be connected to a fixed length section of the riser extending to the subsea wellbore, and wherein the slip joint is provided with a locking mechanism adapted to lock the slip joint in a collapsed position.

In an embodiment of the floating body according to the invention, the floating body further comprises a drillers cabin deck and a drillers cabin thereon. Preferably, the lower stationary position of the working deck being at said drillers cabin deck level.

The height of the riser above the drillers cabin deck with the drillers cabin allows for the drilling personnel in this cabin to have a direct view on equipment in the upper riser section and all lines attached thereto, with the working deck in heave motion in the elevated heave motion compensation range.

Further, the invention relates to a method for drilling a subsea wellbore, wherein use is made of a system according to the invention.

In an embodiment of the method according to the invention, the method comprises a step of arranging a riser string between a subsea wellhead and the floating body, e.g. a drilling vessel, which riser string includes a slip joint. In one mode the slip joint is unlocked, and wherein in another mode the slip joint is collapsed and locked, such that the heave compensation system is operative.

In an embodiment of the method according to the invention, the floating body has a mobile working deck that rests on the riser, and wherein the working deck performs a compensated heave motion relative to the floating body in a heave motion compensation range as the slip joint is locked.

In an embodiment it is envisaged that the inventive system is embodied so as to allow for drilling and in said process adding new drill pipe to the drill string whilst the slip joint is in collapsed and locked position, e.g. with the working deck being in heave compensation mode, e.g. resting on the top end of the riser.

In an embodiment of the method according to the invention, the method comprises steps of adjusting a multiple fall arrangement of the tubular string main hoisting device, e.g. adjusting a suspension of the travelling block from a 12-fall arrangement to an 8-fall arrangement and valve controlling i.e. opening or closing a by-pass channel of the hydraulic deck compensator in accordance with an adjustment of said multiple fall arrangement of the main hoisting device, e.g. opening the by-pass channel in response to an adjustment of the main hoisting device from a 12-fall arrangement to an 8-fall arrangement.

According to a second aspect, the invention relates to an offshore drilling system and method including the features as defined in claims 1 and 2, but without a hydraulic interconnection in between the main hoisting device and the deck compensator. The coupling in heave motion in between the main hoisting device and the deck compensator may be arranged in another way, e.g. by a control unit including electronics and separate actuators to actively control both an heave motion of the main hoisting device and the deck compensator. Advantageously, the deck compensator including a hydraulic deck cylinder with a valve controllable by-pass channel can be adapted in a robust and reliable manner in correspondence with an adjustment of a multiple fall arrangement of the main hoisting device.

According to the second aspect, the invention relates to an offshore drilling system for performing subsea wellbore related activities, e.g. drilling a subsea wellbore, wherein the drilling system comprises:

- a drilling tower (10) having a top and a base, which drilling tower (10) is to be positioned at or near a moon pool (5, 5*a*, 5*b*) of a floating body (1), e.g. a drilling vessel or platform;
- a tubular string main hoisting device, the tubular string for example being a drill string (15), said main hoisting device comprising:
- a main hoisting winch (20, 21) and main cable (22) connected to said winch;
- a crown block (23) and a travelling block (24) suspended from said crown block in a multiple fall arrangement of said main cable, which travelling block is adapted to suspend a tubular string, e.g. a drill string (15), therefrom along a firing line (16), e.g. with an intermediate topdrive (18) adapted to provide a rotary drive for a drill string;
- a heave compensation system adapted to provide heave compensation of the travelling block (24), the heave compensation system comprising a main cable heave compensation sheave (30, 31) in the path between said main hoisting winch (20, 21) and the travelling block (24), a hydraulic sheave compensator (32, 33) connected to said main cable heave compensation sheave (30, 31);
- a mobile working deck (70) which is movable with respect to the drilling tower (10) along the firing line (16) within a motion range including a heave compensation motion range (72);
- the heave compensation system further adapted to provide heave compensation of the mobile working deck (70), wherein the heave compensation system further comprises a hydraulic deck compensator (60), which deck compensator (60) is connected to the floating body and to the mobile working deck (70) to provide a heave compensated motion of the working deck (70) relative to the floating body (1), wherein the deck compensator (60) is operatively coupled to the hydraulic sheave compensator (32, 33) of the heave compensation system, such that in operation the deck compensator (60) moves synchronously with the sheave compensator (32, 33) of the heave compensation system, wherein the hydraulic deck compensator (60) comprises at least one double acting hydraulic cylinder (61) having a cylinder housing (610), a piston (613) and a piston rod (614) which piston subdivides the cylinder housing in a first cylinder chamber (611) at a piston side and a second cylinder chamber (612) at an opposite rod side of the piston (613), wherein the hydraulic cylinder (61) further comprises a valve controlled by-pass channel (63,631) which allows to interconnect the first and second cylinder chamber (611, 612), wherein the piston (613) has a piston area at the piston side to be pressurised to extend the piston rod out of the cylinder housing and a ring-shaped piston area at the rod side to be pressurised to return the piston rod into the cylinder housing, in which an effective piston area (615) at the piston side is in case of a closed by-pass channel (63) a factor, e.g. a factor 1.5, larger than an effective piston area (615) in case of an open by-pass channel (63), wherein said factor is configured in accordance with a multiple fall arrangement of the main hoisting device which is coupled in heave motion and which hoisting device comprises one or more main cable sheaves connected to the travelling block (24) which have an individual lower latching device (25) allowing to connect and disconnect an individual sheave to and from the travelling block (24) to adjust a fall arrangement, e.g. 12-fall instead of 8-fall, of the hoisting device by the same factor.

The aspects of the invention will now be explained with reference to the drawings. In the drawings.

With reference to the drawings an example of an offshore drilling system for performing subsea wellbore related activities, e.g. drilling a subsea wellbore, according to the invention will be discussed.

Figure 1:
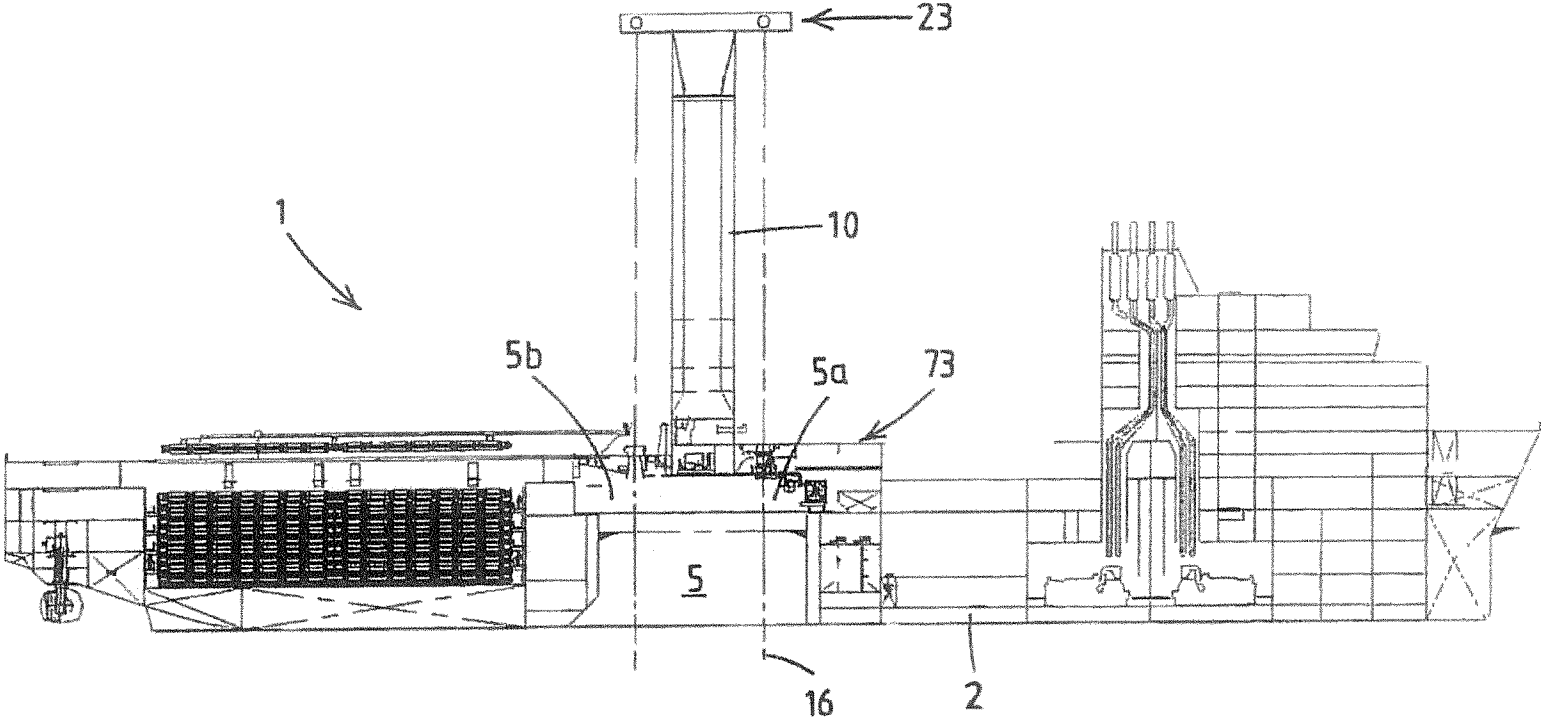
FIG. 1 shows schematically in vertical cross-section a drilling vessel according to the invention.
Figure 2:
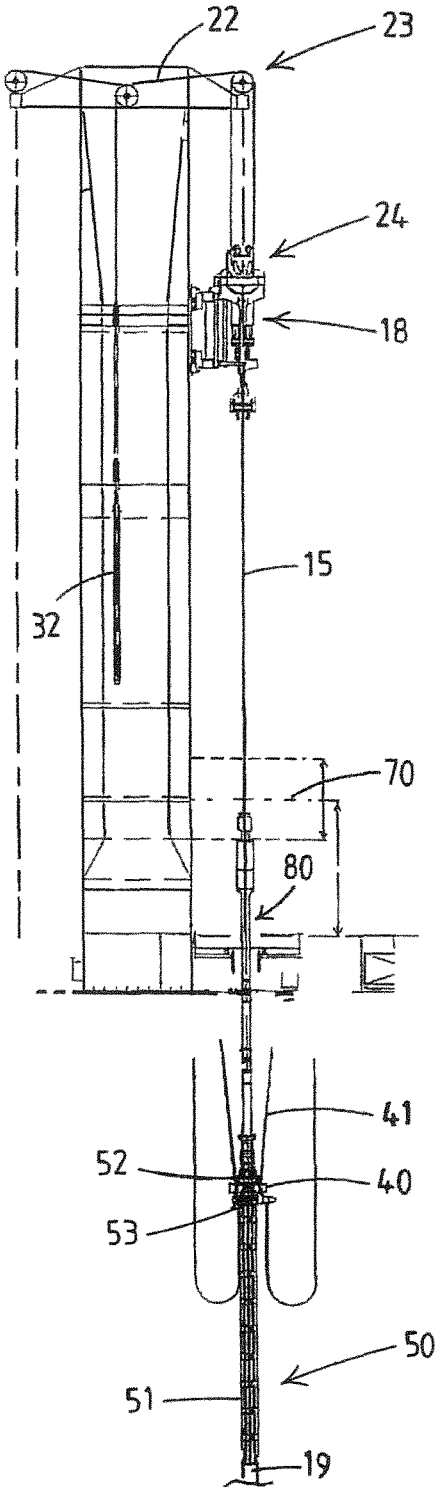
FIG. 2 shows a portion of the vessel with the drilling mast with a compensator cylinder therein and a mobile working deck, as well as a slip joint.

As shown in FIG. 1 and FIG. 2, the system comprises a drilling vessel 1 having a floating hull 2 subjected to heave motion, the hull comprising a moonpool 5, here the moonpool having a fore portion 5*a* and an aft portion 5*b*.

As is preferred the vessel 1 is a mono-hull vessel with the moonpool extending through the design waterline of the vessel. In another embodiment, for example, the vessel is a semi-submersible vessel having submergible pontoons (possibly an annular pontoon) with columns thereon that support an above-waterline deck box structure. The moonpool may then be arranged in the deck box structure.

The vessel is equipped with a drilling tower 10 at or near the moonpool. In this example, as is preferred, the tower is a mast having a closed outer wall and having a top and a base. The base of the mast is secured to the hull 2. In this example the mast is mounted above the moonpool 5 with the base spanning the moonpool in transverse direction.

In another embodiment the tower 10 can be embodied as a derrick, e.g. with a latticed derrick frame standing over the moonpool.

The vessel 1 is provided with a tubular string main hoisting device, the tubular string for example being a drill string 15.

Figure 3:
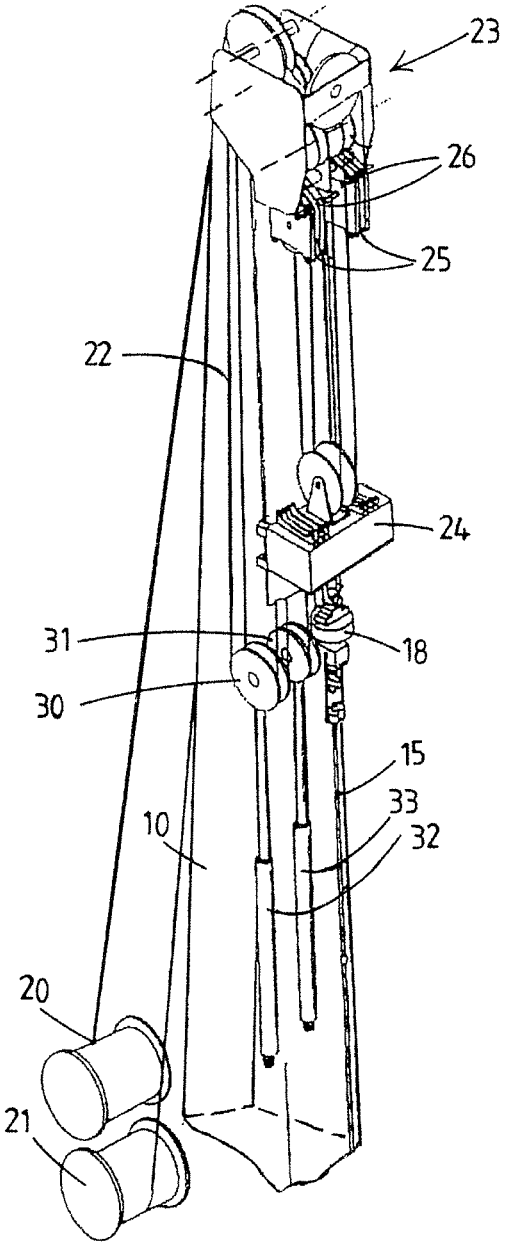
FIG. 3 shows in a perspective view a main hoisting device provided with a heave compensation system including two sheave compensators.
Figure 4:
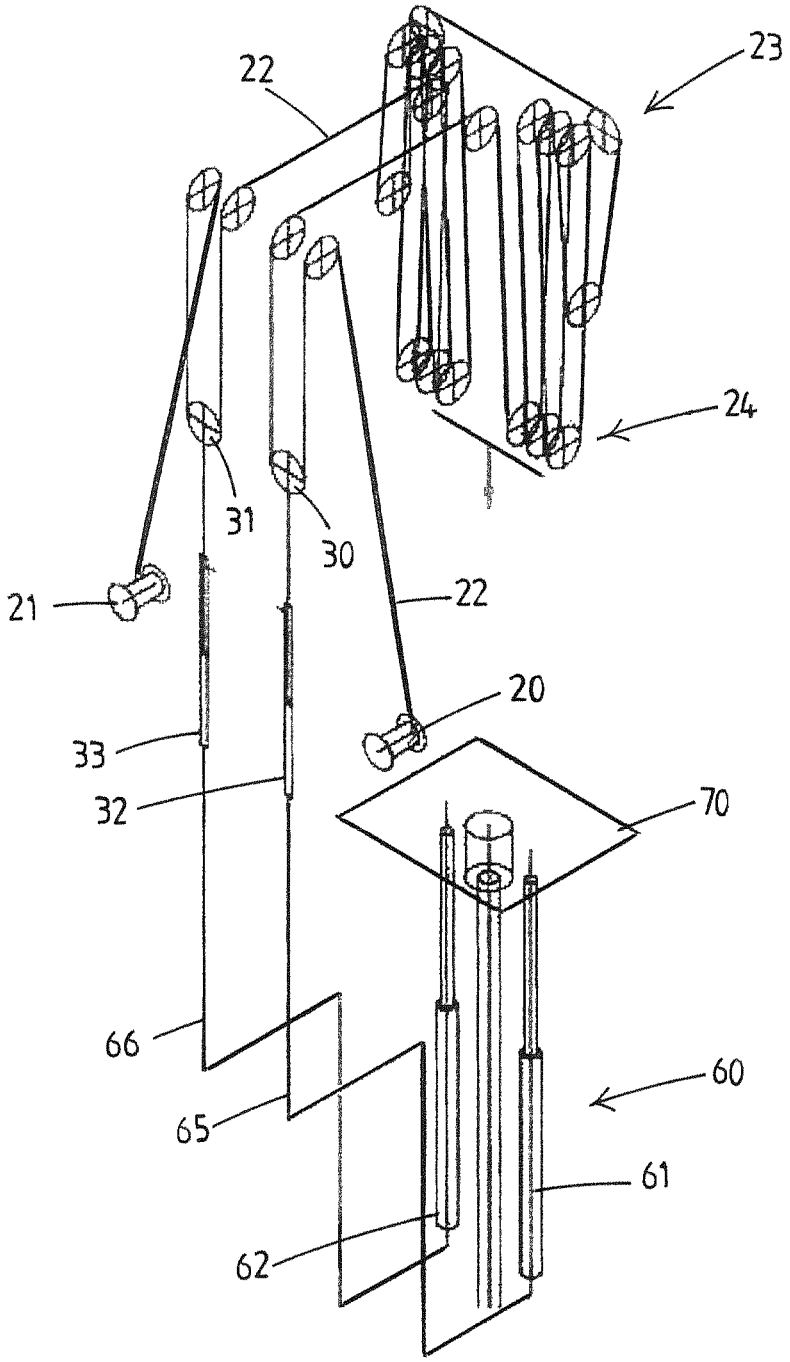
FIG. 4 shows in a perspective view the heave motion system according to the invention, wherein a sheave compensator is hydraulically connected to a deck compensator.

The main hoisting device is further illustrated in FIG. 3 and FIG. 4.

Figure 8:
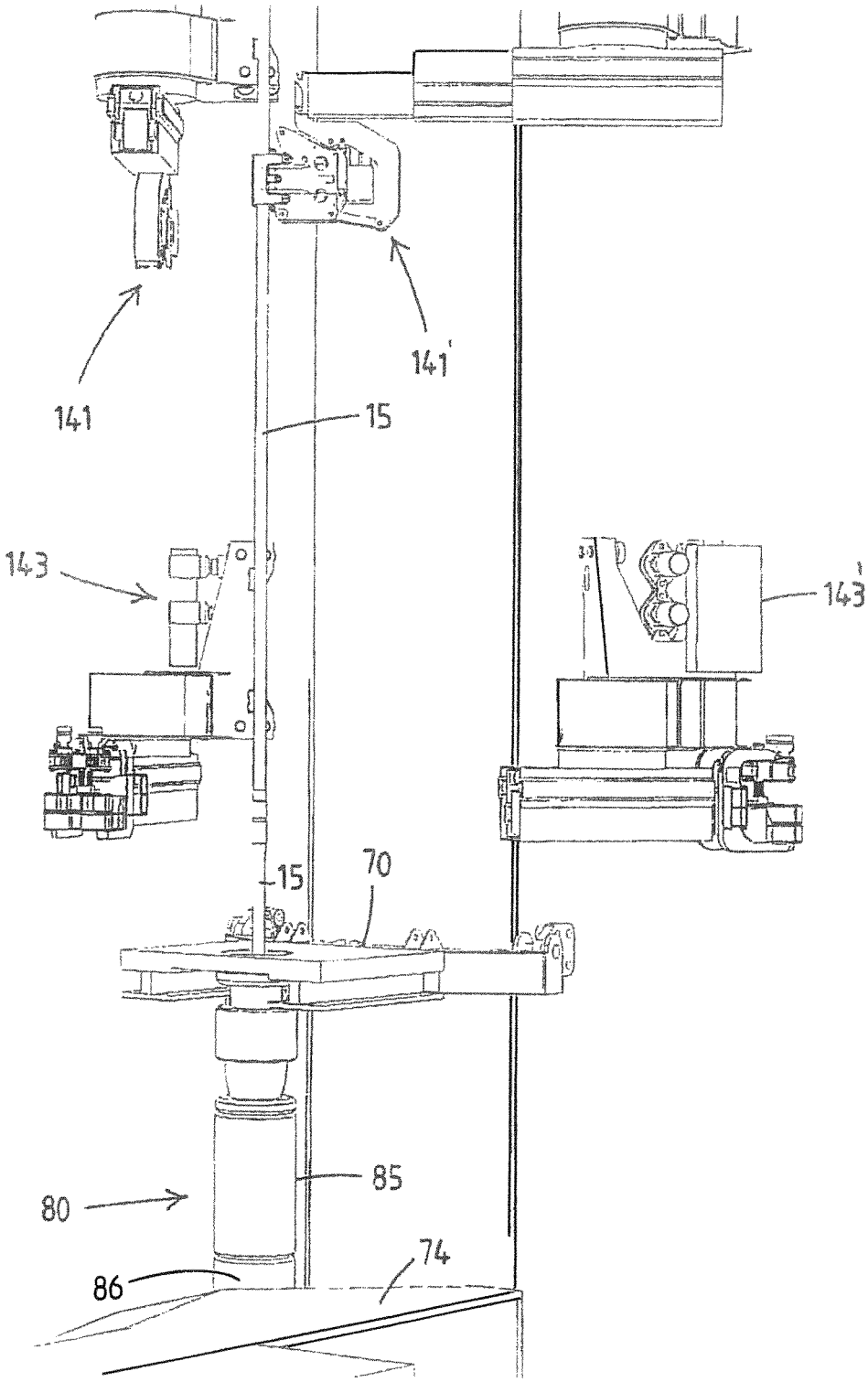
FIG. 8 illustrates the assembly of a new drill pipe to the drill string in heave motion

The main hoisting device comprises:

- a main hoisting winch, here first and second winches 20, 21, and a main cable 22 that is connected to said winches 20, 21,
- a crown block 23, here at the top end of the mast 10, and a travelling block 24 that is suspended from the crown block 23 in a multiple fall arrangement of the main cable 22. In FIG. 8, the travelling block 24 is suspended in a 12-fall arrangement from the crown block 23.

As shown in FIG. 3 one or more main cable sheaves connected to the travelling block 24 have an individual lower latching device 25 allowing to connect and disconnect the individual sheave to and from the travelling block 24. Preferably these one or more sheaves also have an upper latching device 26 allowing to latch the sheave to the crown block if the sheave is disconnected from the travelling block. This "splittable block" arrangement is known in the art.

The travelling block 24 is adapted to suspend a tubular string, e.g. the drill string 15, therefrom along a firing line 16, here shown (as preferred) with an intermediate topdrive 18 that is supported by the travelling block 24 and that is adapted to provide a rotary drive for the drill string.

Figure 5:
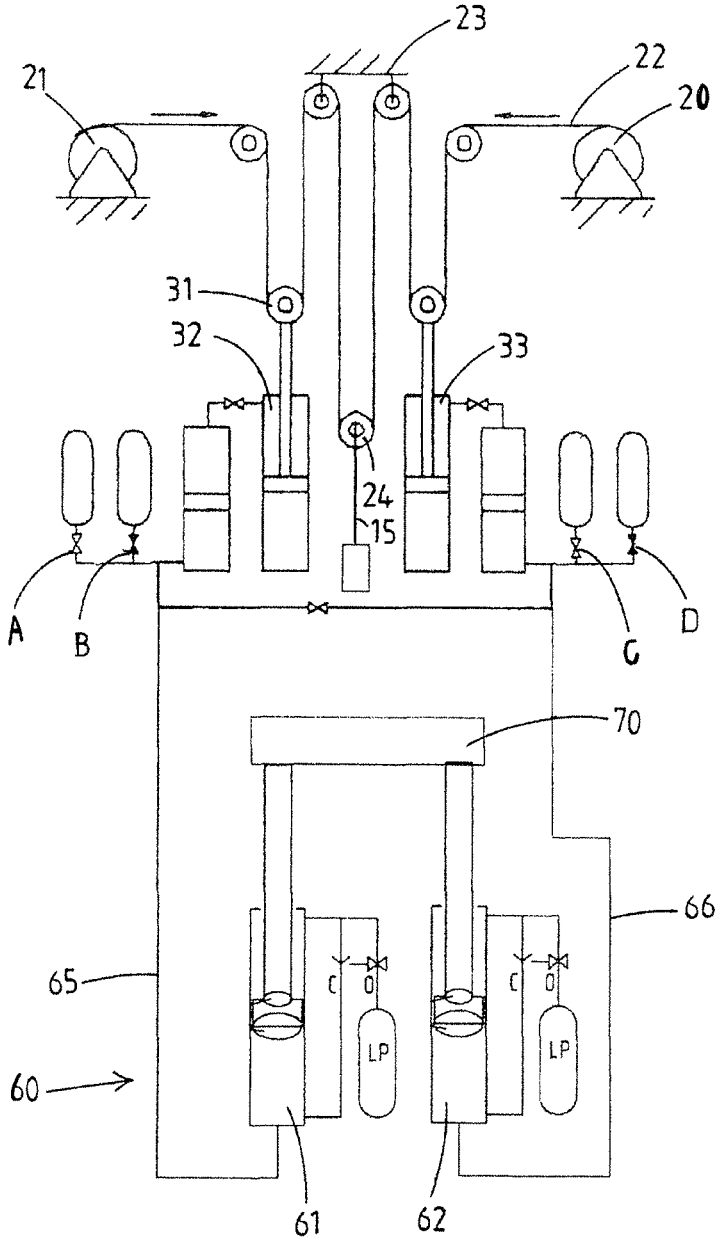
FIG. 5 shows the heave motion system of FIG. 4 in a schematic view.

FIG. 5 shows in a schematic view, the main hoisting device which comprises a first main hoisting winch 20 and the second main hoisting winch 21, wherein the main cable 22 is connected at either end thereof to a respective one of the first and second main hoisting winches 20,21.

The vessel 1 is provided with a heave compensation system adapted to provide heave compensation of the travelling block 24. This heave compensation system comprises a main cable heave compensation sheave, here two sheaves 30,31, one each in the path between each of the main hoisting winches 20, 21 and the travelling block 24. These sheaves 30, 31 are each connected to a passive and/or active heave motion compensator device, here including hydraulic cylinders, also called sheave compensators 32, 33, which are each connected to a respective main cable heave compensation cable sheave 30, 31.

In the shown embodiment each sheave compensator comprises a hydraulic cylinder having a piston rod, the main cable heave compensation sheave 30,31 being connected to said piston rod. For example the compensator cylinders 32, 33 each have a stroke between 5 and 15 meters, e.g. of 6 meters. As is preferred, the cylinders 32, 33 are mounted within the mast in vertical orientation. FIG. 3 shows the lengthy cylinders 32, 33 including a fully extended position of the piston rods thereof which are preferably mounted vertically within the mast 10.

As further shown in FIG. 5, as an example of a passive heave compensation system, each sheave compensator 32, 33 is connected to a hydraulic/gas separator cylinder A, B, C, D, one chamber thereof being connected to a gas buffer as is known in the art.

As shown in FIG. 4, the heave compensation system is arranged to provide heave compensation of the travelling block 24 of the main hoisting device, but also to provide heave compensation of a mobile working deck 70. The mobile working deck 70 is positioned above the moonpool 5. The working deck 70 comprises equipment, like a slip tool 77, to carry out operational steps to a tubular string, in particular a drill string 15.

The mobile working deck 70 is supported by a deck compensator. The deck compensator is connected to the vessel 1 and the mobile working deck 70. The deck compensator comprises at least one double acting hydraulic cylinder, here two hydraulic cylinders 61, 62 which are positioned below the mobile working deck. The hydraulic cylinders 61, 62 are positioned opposite each other. The hydraulic cylinders 61, 62 are positioned at opposite sides of the firing line 16. Here, the firing line 16 and the two hydraulic cylinders 61, 62 are positioned in a common plane which is oriented in a vertical direction. Advantageously, the arrangement of the deck compensator including two hydraulic cylinders 61, 62 contribute to the accessibility of the area below the working deck 70. The deck compensator e.g. allows access to the area for drilling equipment or a guidance of conduits.

As shown in FIG. 4, the sheave compensator 32, 33 and the deck compensator 60 are hydraulically interconnected by a hydraulic conduit 65, 66. The first hydraulic sheave cylinder 32 is hydraulically connected via the first hydraulic conduit 65 to the first hydraulic deck cylinder 61 and the second hydraulic sheave cylinder 33 is hydraulically connected via the hydraulic conduit 66 to the second hydraulic deck cylinder 62. Advantageously, the hydraulic interconnection of the sheave compensator and the deck compensator provides a synchronous compensated heave motion of both the travelling block 24 and the working deck 70.

The mobile working deck 70 is movable with respect to the vessel 1, in particular the drilling tower 10, along the firing line 16 within a motion range including a heave compensation motion range 72. The motion range is further illustrated and explained hereafter with reference to FIG. 10.

Figure 6A:
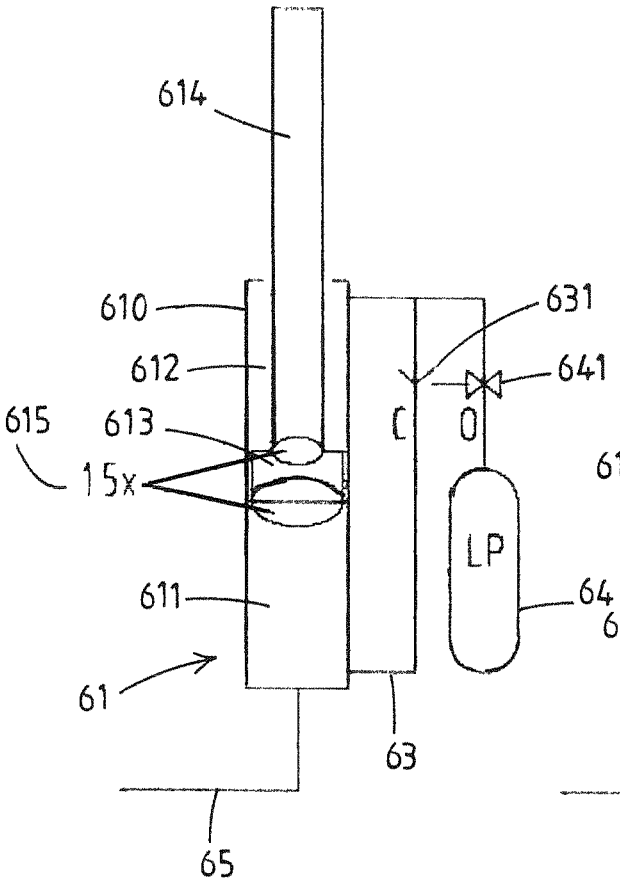
FIGS. 6A and 6B shows a valve controlled deck compensator to allow an adjustment in correspondence with an adjustment to a multiple fall arrangement of the main hoisting device.

FIG. 6A shows the embodiment of the hydraulic deck cylinder 61 in further detail. The hydraulic deck cylinder 61 comprises a cylinder housing 610, a piston 613 and a piston rod 614. The piston subdivides the cylinder housing 610 in a first cylinder chamber 611 at a piston side and a second cylinder chamber 612 at an opposite rod side of the piston 613. The hydraulic deck cylinder 61 further comprises a valve controlled by-pass channel 63 which allows to interconnect the first and second cylinder chamber 611, 612. The by-pass channel 63 comprises a by-pass valve 631 which can be opened or closed to respectively open or close the by-pass channel 63.

FIG. 6A shows a closed by-pass channel 63. The first and second cylinder chamber 611, 612 inside the cylinder housing 610 are separated from each other by the piston 613. The by-pass valve 631 is closed.

Figure 6B:
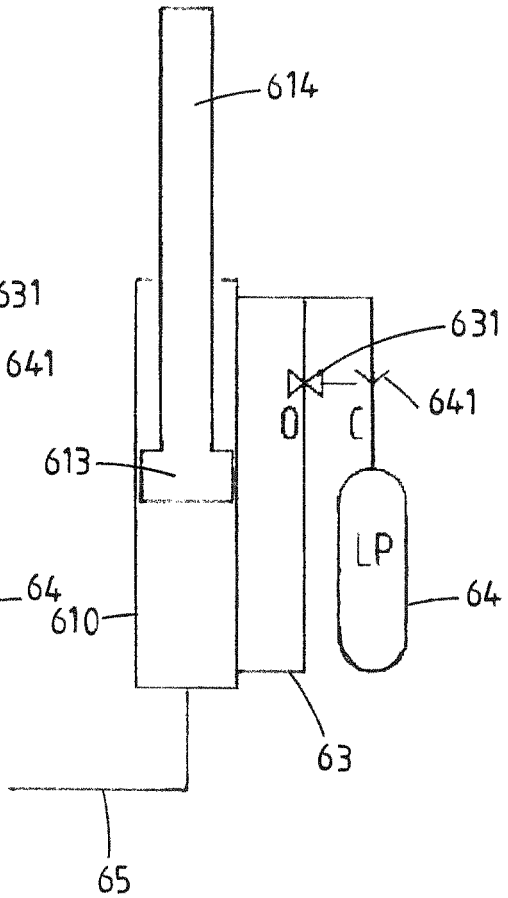

FIG. 6B shows an open by-pass channel 63 which interconnects the first and second cylinder chamber 611, 612 inside the cylinder housing 610. The by-pass valve 631 is open.

In comparison with the configuration of the deck cylinder 61 as shown in FIG. 6B, the configuration of the deck cylinder 61 as shown in FIG. 6A includes a larger effective piston area 615 to operate the deck cylinder 61. The open by-pass channel 63 in FIG. 6B reduces the effective piston area 615 in that in operation a hydraulic pressure acts on a ring-shaped piston area at the rod side of the piston 613. In case of an open by-pass channel 63, the resulting effective piston area is equal to the piston area at the piston side minus the ring-shaped piston area at the rod side of the piston 613. In case of a closed by-pass channel 63, the resulting effective piston area is equal to the piston area as the piston side.

Advantageously, the difference in between the effective piston area of a closed by-pass channel 63 and the effective piston area of an open by-pass channel 63 is equal to a factor which corresponds with a factor selectable in a multiple fall arrangement of a hoisting device which is coupled in heave motion to the working deck 70. When for example, a combination with a multiple fall arrangement of a hoisting device includes a selective 12-fall arrangement and an 8-fall arrangement, the factor of the selective fall arrangements is 1.5. In that case, this same factor is configured in the hydraulic deck cylinder 61, by configuring the piston area and ring-shaped piston area, such that an effective piston area 615 of a factor 1.5 results.

The by-pass channel 63 is connected to an accumulator 64 for accumulating a volume of hydraulic liquid. Preferably, the accumulator 64 is valve controlled by an accumulator valve 641, such that the accumulator can be closed in case that the bypass channel is open and in that the accumulator can be opened in case that the bypass channel is closed. The accumulator 64 is fluidly connected to the bypass channel 63 at a position in between the second chamber of the hydraulic cylinder 61 of the deck compensator 60 and the accumulator valve 613. The accumulator allows an accumulation of hydraulic liquid from the second chamber in case that the bypass channel 63 is closed. In case that the bypass channel is open, the hydraulic liquid can flow out from the second chamber to the first chamber via the bypass channel 63, such that the accumulator can be closed.

Figure 9:
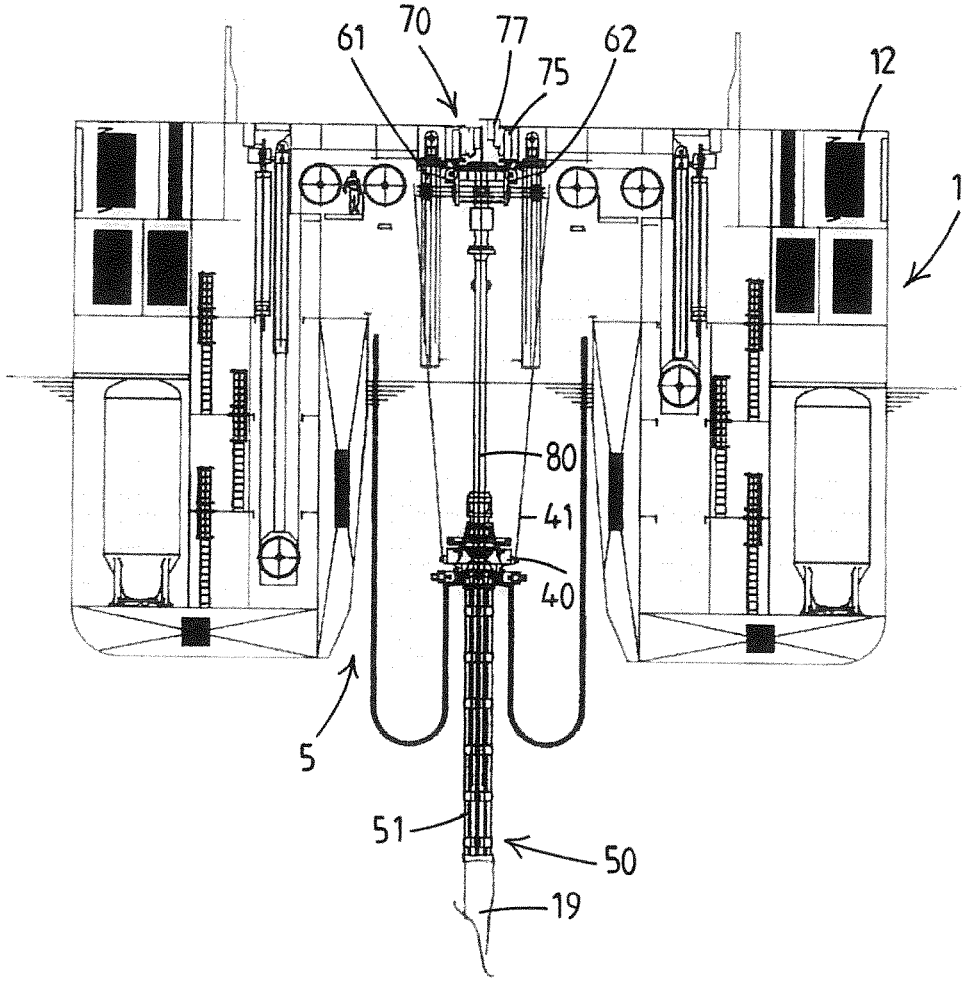
FIG. 9 shows in a cross sectional view a riser, a slip joint, a vessel including a riser tensioning system and a heave motion compensated working platform.
Figure 10:
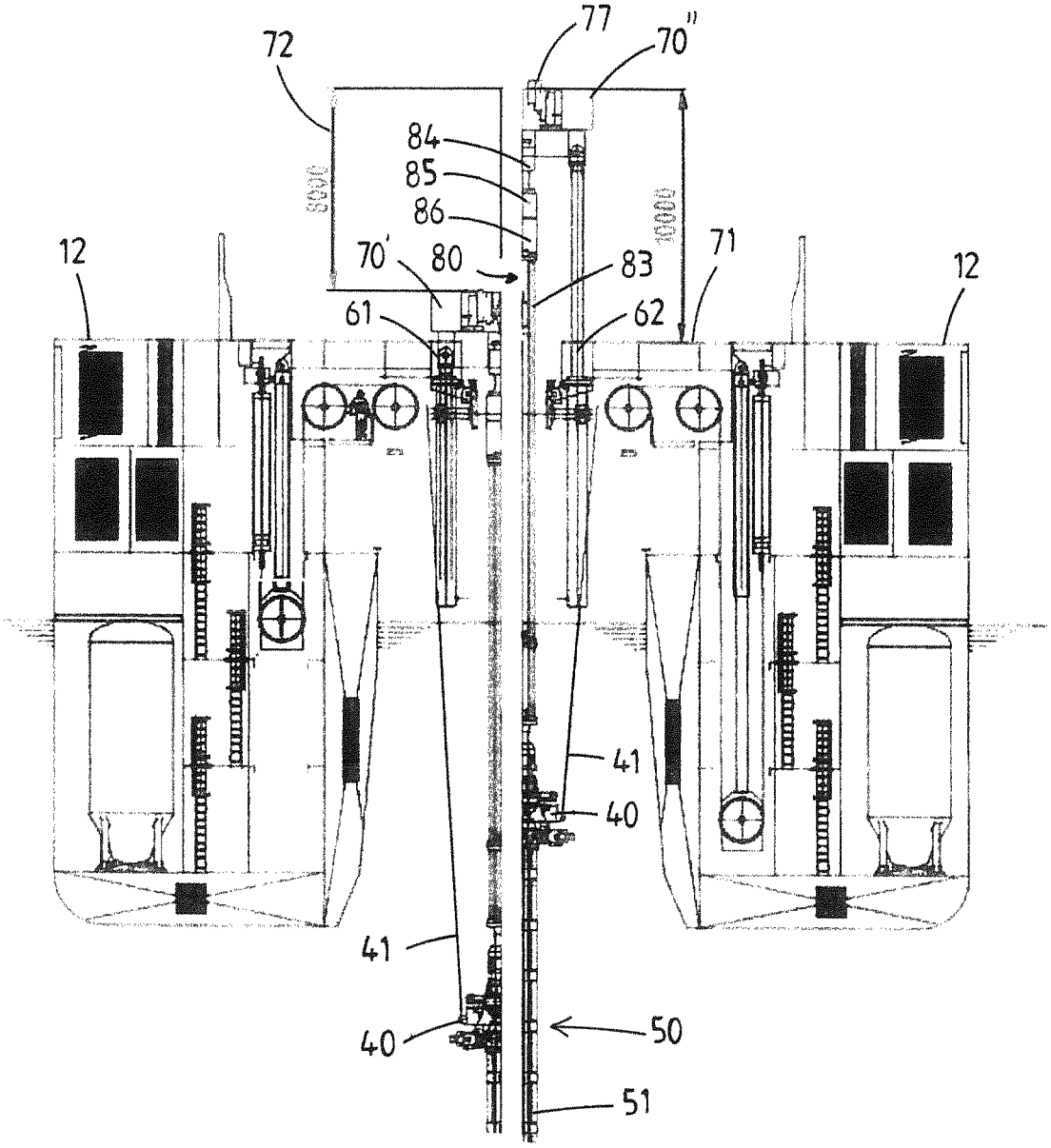
FIG. 10 shows in a left sided view a deck compensator of the heave motion system in a lower position and in a right sided view a deck compensator of the heave motion system in an upper position.

As shown in FIGS. 2, 9 and 10, the vessel is furthermore provided with a riser tensioning system that is adapted to connect to a riser 19 extending along the firing line 16 between a subsea wellbore, e.g. a BOP on the subsea wellhead, and the vessel 1. The riser tensioning system comprises a tension ring 40 and tensioner members 41 connected to the tension ring 40. In the depicted example a wire line tensioning system is shown, with the members 41 being wires that run from the ring 40 upward to sheaves 42 and then to a tensioning arrangement, e.g. including cylinders 43 and a gas buffer.

The drawings further show the presence of a slip joint 50 having a lower outer slip joint barrel 51 and an upper inner slip joint barrel 52. As is known in the art the outer barrel 51 is adapted to be connected at its lower end, e.g. via bolts, to a fixed length section of the riser 19 extending to the seabed. As is known in the art and not shown in detail here the slip joint is provided with a locking mechanism 53, e.g. including hydraulically activated locking dogs, which is adapted to lock the slip joint in a collapsed position. As explained in the introduction the slip joint has a higher pressure rating when collapsed and locked that in dynamic stroking mode, e.g. as the locked position includes an operative metal-to-metal seal in the slip joint.

As is known in the art the tension ring 40 of the riser tensioning system is adapted to be connected to the outer barrel 51 of the slip joint 50, thereby allowing to absorb the effective weight of the riser.

FIG. 7-10 further show the vessel 1 provided with a vertically mobile working deck 70 that is vertically mobile within a motion range including a lower stationary position 71, wherein the working deck is used as a drill floor deck stationary with respect to the hull of the vessel in which the slip joint 50 is unlocked. The shown position of the working deck 70 in FIG. 9 is also called a regular position of the working deck in which the working deck is aligned with an overhead deck structure 12. The motion range further includes a heave compensation motion range 72 that lies higher than the lower stationary position 71. In this heave compensation motion range the working deck 70 can perform heave compensation motion relative to the hull of the vessel.

For example the heave compensation motion range is between 5 and 10 meters, e.g. 6 meters. For example the average height of the working deck in heave motion above the driller cabin deck 73 with cabin 74 of the vessel is about 10 meters.

The drawings show that the working deck 70 has an opening 75 therein that is aligned with the firing line 16, the opening 75 being dimensioned to at least allow for passage of the tubular string 15 that extends into and through the riser 19. The working deck is provided with a tubular string suspension device, e.g. a device known as a slip tool 77 in the drilling field.

The working deck 70 may be provided with a rotary table.

The system further comprises an upper riser section 80 that is mounted at the top of the riser, more in particular mounted on the inner barrel 52 of a slip joint 50, and extends upward from the inner barrel 52 of the slip joint 50 at least to above the lower stationary position 71 of the working deck 70', preferably to the heave compensation motion range of the deck 70", as visible in FIG. 10.

In the depicted example in FIG. 10, the working deck 70 rests on the upper riser section 80 and this upper riser section 80 is the sole vertical loads support of the working deck 70.

The upper riser section 80 forms a rigid connection between the actual end of the inner barrel 52 and a riser member 83 which extends upward to above the level 71, even in the lowermost heave motion situation depicted at a left side in FIG. 10. Above said riser member 83 equipment to be integrated with the riser top, such as preferably at least a rotating control device (RCD) 84, and a mudline connector 85 are mounted. For example other riser integrated equipment like an annular BOP 86 may be arranged here as well.

As best seen in FIG. 8, the height of the riser above the drillers cabin deck 73 with the drillers cabin 74 allows for the drilling personnel in this cabin to have a direct view on equipment in the upper riser section 80 and all lines attached thereto when operated with the slip joint 50 in collapsed and locked position, with the working deck 70 in compensated heave motion in the elevated heave motion compensation range.

The inventive system can also be embodied such that the working deck 70, in heave motion compensation mode, does not rest with its weight and, if present, any load thereon (e.g. from the drill string suspended from a slip device on the working deck 70 on or entirely on the upper riser section.

The vessel is provided with a vertically mobile working deck 70 that is vertically mobile within a motion range including a lower stationary position 71, wherein the working deck is used as stationary drill floor deck with the slip joint unlocked, see FIG. 9, and the motion range further including a heave compensation motion range 72 that lies higher than said lower stationary position 71. Such positions of the working deck 70',70" are shown in FIG. 10. The vessel is provided with a drillers cabin deck 73 with a drillers cabin (not shown) thereon, and the lower stationary position of the working deck is at said drillers cabin deck level.

Figure 7:
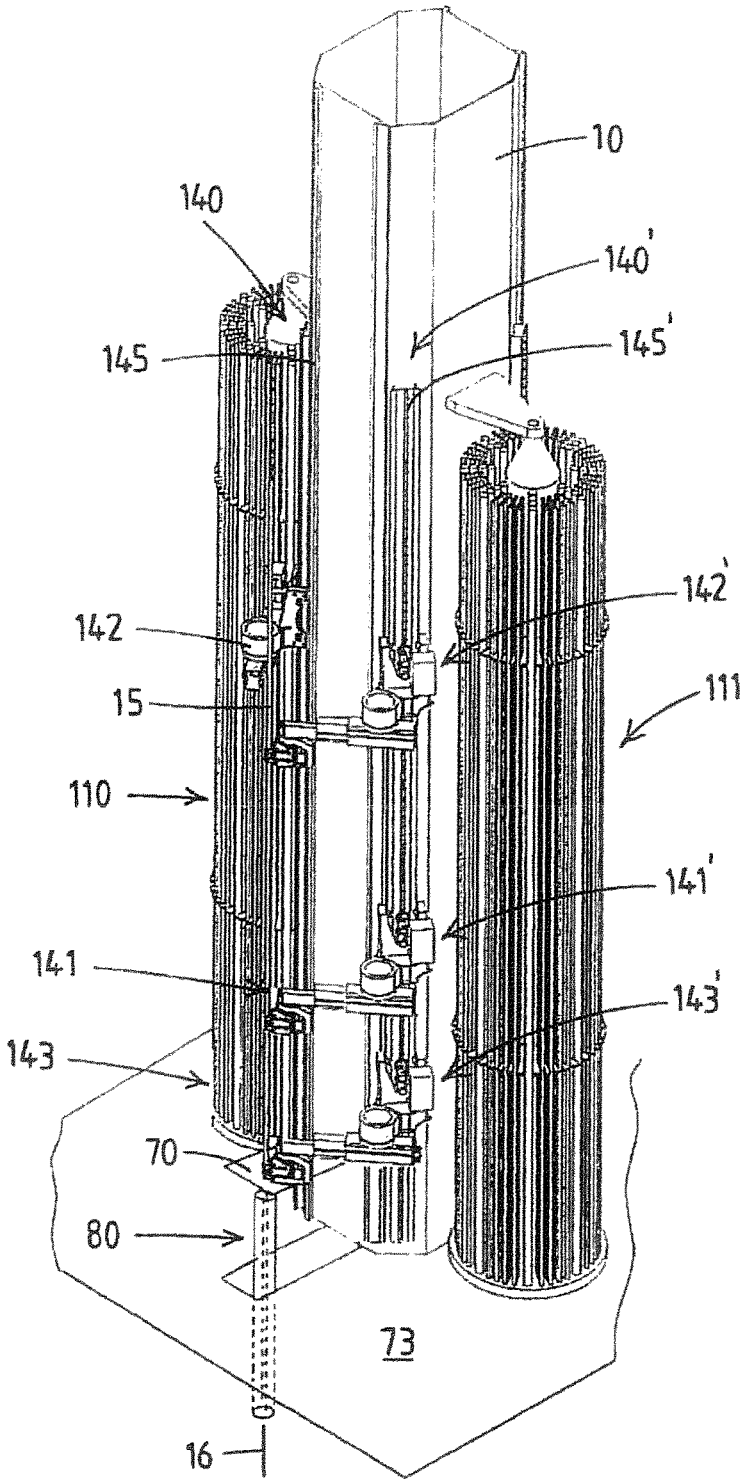
FIG. 7 illustrates the mast of the vessel of FIG. 1, with a mobile working deck, the mast being provided with a vertical rails whereon two mobile pipe racker arm units and a mobile iron roughneck device are mobile in heave compensation mode, and with pipe storage carousels mounted on the hull.

As shown further in FIG. 7. the vessel is furthermore provided with a drilling tower, here embodied as a mast 10, of a closed hollow construction. The top section including the drawworks and topdrive 18 as already shown in FIG. 3 has been removed in the drawing of FIG. 7. Also shown are the storage racks 110, 111 for tubulars, e.g. drill pipes and casing, here multi-jointed tubulars. Such racks are also referred to as carousels.

At the side of the mast 10 facing the firing line 16 the drilling system is provided with a pipe racker system, here comprising two tubular racking devices 140 and 140', each mounted at a corner of the mast 10. If no mast is present, e.g. with a latticed derrick, a support structure can be provided to arrive at a similar arrangement of the racking devices 140 and 140' relative to the firing line 16.

In the shown embodiment of FIG. 8, each racking device 140, 140' has multiple, here three racker assemblies. Here a lower first tubular racker assembly 141, 141', a second tubular racker assembly 142, 142', operable at a greater height than the first tubular racker assembly, and a third tubular racker assembly 143, 143'.

Each set of racker assemblies is arranged on a common vertical rails 145, 145' that is fixed to the mast 10, here each at a corner thereof.

In the embodiment of FIG. 8, a drill pipe multi-joint tubular may be held by racker assemblies 142' and 141' in the firing line above the well center 27, thereby allowing to connect the tubular to the upper riser section 80. Each of said assemblies 142' and 141' carries a tubular gripper member **142'*t* and 141'*t*** at the end of the motion arm of the assembly.

The lower racker assembly 143 of the other racker device 140 carries an iron roughneck device 150, optionally with a spinner thereon as well.

According to a preferred embodiment of the invention, the pipe racker system is provided with a heave motion synchronization system, adapted to bring a drill pipe retrieved from a drill pipe storage rack into a vertical motion synchronous with the heave motion of the upper end of the riser, e.g. of the working deck resting thereon, thereby allowing the interconnect the drill pipe to a drill pipe string suspended from a slip device. Hence, in the shown embodiment, the two tubular racking devices 140 and 140', each with three racker assemblies, are mobile in heave compensation mode.

It is both conceivable that the racker assemblies are mobile in heave compensation mode with respect to their common vertical rails 145, 145', and that the common vertical rails 145, 145' with the racker assemblies are mobile in heave compensation mode with respect to the mast 10.

In FIG. 8 the assembly of a new drill pipe 15, held by the pipe racker system of FIG. 7 comprising racker assemblies mounted on vertical rails, which pipe racker system is provided with a heave motion synchronization system that brings the drill pipe 15 retrieved from a drill pipe storage rack (not shown in FIG. 8) into a vertical motion synchronous with the heave motion of the upper end of the riser, thereby allowing the interconnect the drill pipe 15 to a drill pipe string suspended from a slip device to the drill string in heave motion is shown in a detailed perspective view. In FIG. 8, racker assemblies 143 and 143' and 141 and 141' are visible, wherein racker assembly 141' grips the drill pipe 15.

In the depicted example of FIG. 10, the working deck 70 rests on the upper riser section 80 and this upper riser section 80 is the sole vertical loads support of the working deck 70.

The upper riser section 80 comprises equipment to be integrated with the riser top, such as preferably at least a rotating control device (RCD) 84, and a mudline connector 85.

The height of the riser above the drillers cabin deck 73 with the drillers cabin 74 allows for the drilling personnel in this cabin to have a direct view on equipment in the upper riser section 80 and all lines attached thereto, with the working deck 70 in heave motion in the elevated heave motion compensation range.

Thus, the invention provides an offshore drilling system and method for drilling a subsea wellbore, wherein use is made of such a system. The offshore drilling system comprises a drilling tower 10, a tubular string hoisting device with a crown block 23 and a travelling block 24 suspended from said crown block in a multiple fall arrangement, a heave compensation system adapted to provide heave compensation of the travelling block 24. The heave compensation system comprises a hydraulic sheave compensator 32, 33. The system further comprises a mobile working deck 70 which is movable with respect to the drilling tower 10 within a motion range including a heave compensation motion range 72. The heave compensation system is further adapted to provide heave compensation of the mobile working deck 70 by a hydraulic deck compensator 60, which is hydraulically connected via a hydraulic conduit 65,66 to the hydraulic sheave compensator 32, 33, such that in operation the deck compensator 60 moves synchronously with the sheave compensator 32, 33 of the heave compensation system.

| Reference numbers: | |
|---|---|
| 1 | vessel |
| 2 | floating hull |
| 5 | moonpool |
| 5a | moonpool fore portion |
| 5b | moonpool aft portion |
| 10 | drilling tower |
| 12 | overhead deck structure |
| 15 | drill string |
| 16 | firing line |
| 18 | top drive |
| 19 | riser |
| 20 | first winch |
| 21 | second winch |
| 22 | main cable |
| 23 | crown block |
| 24 | traveling block |
| 25 | lower latching device |
| 26 | upper latching device |
| 27 | well centre |
| 30 | first sheave; main cable heave compensation sheave |
| 31 | second sheave; main cable heave compensation sheave |
| 32 | first hydraulic cylinder; heave motion compensator |
| 33 | second hydraulic cylinder; heave motion compensator |
| 40 | tension ring |
| 41 | tensioner member |
| 42 | sheave |
| 43 | cylinder |
| 50 | slip joint |
| 51 | outer slip joint barrel |
| 52 | inner slip joint barrel |
| 53 | locking mechanism |

-continued

| Reference numbers: | |
|---|---|
| 60 | deck compensator |
| 61 | hydraulic deck cylinder |
| 62 | hydraulic deck cylinder |
| 65 | hydraulic conduit |
| 66 | hydraulic conduit |
| 70 | mobile working deck |
| 71 | lower stationary position |
| 72 | heave compensation motion range |
| 73 | driller cabin deck |
| 74 | cabin |
| 75 | deck opening |
| 77 | slip tool |
| 80 | upper riser section |
| 82 | collar |
| 83 | riser member |
| 84 | RCD (rotating control device) |
| 85 | mudline connector |
| 86 | BOP (blow out preventor) |
| 110 | first storage rack |
| 111 | second storage rack |
| 140 | tubular racking device |
| 140' | tubular racking device |
| 141 | lower first racker assembly |
| 141b | base |
| 141m | motion arm |
| 141m-1 | first arm segment |
| 141m-2 | second arm segment |
| 141m-3 | third arm segment |
| 141't | tubular gripper |
| 142 | second tubular racker assembly |
| 143 | third tubular racker assembly |
| 145 | common vertical rails |
| 147 | vertical axis bearing |
| 147a | bearing housing |
| 148 | connector |
| 150 | iron rougnneck device spinner |
| 156 | connector pin |
| 161 | pinion |
| 162 | motor |

The invention claimed is:

1. An offshore drilling system for performing subsea wellbore related activities, wherein the drilling system comprises:

a drilling tower having a top and a base, which drilling tower is to be positioned at or near a moon pool of a floating body;

a riser tensioning system adapted to connect a riser extending along the firing line between the subsea wellbore and the floating body;

a tubular string main hoisting device, said tubular string main hoisting device comprising:

a main hoisting winch and main cable connected to said winch; and a crown block and a travelling block suspended from said crown block in a multiple fall arrangement of said main cable, which travelling block is adapted to suspend a tubular string therefrom along a firing line;

a heave compensation system adapted to provide heave compensation of the travelling block, the heave compensation system comprising a main cable heave compensation sheave in the path between said main hoisting winch and the travelling block, a hydraulic sheave compensator connected to said main cable heave compensation sheave; and a mobile working deck movable with respect to the drilling tower along the firing line within a motion range including a heave compensation motion range;

wherein the heave compensation system is adapted to provide heave compensation of the mobile working deck, wherein the heave compensation system further comprises a hydraulic deck compensator, which deck compensator is connected to the floating body and to the mobile working deck to provide a heave compensated motion of the working deck relative to the floating body, and wherein the deck compensator is hydraulically connected via a hydraulic conduit to the hydraulic sheave compensator of the heave compensation system, such that in operation the deck compensator moves synchronously with the sheave compensator of the heave compensation system.

2. The system according to claim 1, wherein the hydraulic deck compensator comprises at least one double acting hydraulic cylinder having a cylinder housing, a piston and a piston rod, which piston subdivides the cylinder housing in a first cylinder chamber at a piston side and a second cylinder chamber at an opposite rod side of the piston, wherein the hydraulic cylinder further comprises a valve controlled by-pass channel which allows to interconnect the first and second cylinder chamber, wherein the piston has a piston area at the piston side to be pressurised to extend the piston rod out of the cylinder housing and a ring-shaped piston area at the rod side to be pressurised to return the piston rod into the cylinder housing, in which an effective piston area at the piston side is in case of a closed by-pass channel a factor larger than an effective piston area in case of an open by-pass channel, and wherein said factor is configured in accordance with a multiple fall arrangement of the main hoisting device which is coupled in heave motion and which hoisting device comprises one or more main cable sheaves connected to the travelling block which have an individual lower latching device allowing to connect and disconnect an individual sheave to and from the travelling block to adjust a fall arrangement, of the hoisting device by the same factor.

3. The system according to claim 2, wherein the one or more sheaves also have an upper latching device allowing to latch the sheave to the crown block if the sheave is disconnected from the travelling block.

4. The system according to claim 2, wherein the by-pass channel is connected to an accumulator for accumulating a volume of hydraulic liquid.

5. The system according to claim 4, wherein the accumulator is valve controlled by an accumulator valve, such that the accumulator can be closed in case of an open by-pass channel.

6. The system according to claim 1, wherein the hydraulic deck compensator comprises a pair of hydraulic cylinders positioned at opposite sides of the firing line and being spaced apart to allow for a passage of the riser section in the firing line and between said pair of hydraulic cylinders.

7. The system according to claim 1, wherein the hydraulic deck compensator is arranged in its stationary operative position at a level below the working deck.

8. The system according to claim 1, wherein the motion range includes a lower stationary position and wherein the heave compensation motion range lies higher than said lower stationary position.

9. The system according to claim 1, wherein the first hydraulic compensator is connected to an active actuator to obtain an active control of the first heave compensation system.

10. The system according to claim 1, further comprising at least one of the following features:

the floating body further comprising a drillers cabin deck and a drillers cabin thereon, with the lower stationary position of the working deck being at said drillers cabin deck level;

the crown block and the travelling block suspended from said crown block in a multiple fall arrangement of said main cable, which travelling block is adapted to suspend the tubular string therefrom along the firing line, with an intermediate topdrive adapted to provide a rotary drive for a drill string;

the effective piston area at the piston side is in case of a closed by-pass channel a factor 1.5 larger than the effective piston area in case of an open by-pass channel;

the fall arrangement is adjustable from a 12-fall to a 8-fall arrangement;

the riser tensioning system comprises a tension ring and tension members connected to said tension ring;

a piper racker system is provided with a heave motion synchronisation system adapted to bring a drill pipe retrieved from a drill pipe storage rack into a vertical relative motion synchronous with a relative motion of the upper end of the riser, thereby allowing to interconnect the drill pipe to a drill pipe string suspended from a slip tool;

a slip joint including an outer barrel and an inner barrel, wherein the outer barrel is adapted to be connected to a fixed length section of a riser extending to the subsea wellbore, and wherein the slip joint is provided with a locking mechanism adapted to lock the slip joint in a collapsed position;

an upper riser section that is mounted on the inner barrel of the slip joint and which upper riser section extends upwards from the slip joint at least to above the lower stationary position of the working deck;

an upper riser section that is mounted on the inner barrel of the slip joint and which upper riser section extends upwards from the slip joint at least to above the lower stationary position of the working deck to the heave compensation motion range;

the working deck is adapted to rest onto the upper riser section with said upper riser section being the sole vertical loads support of the working deck;

the tension ring of the riser tensioning system is adapted to be connected to the outer barrel of the slip joint;

a rotating control device (RCD) to close off an annulus between an upper riser section and a tubular string extending through the riser and including at least one flowhead member to allow a connection of at least one hose for transferring an annular fluid flow to the floating body; and a rotating control device (RCD) above the slip joint and below the working deck to close off an annulus between an upper riser section and a tubular string extending through the riser in the course of managed pressure drilling, and including at least one flowhead member to allow a connection of at least one hose for transferring an annular fluid flow to the floating body.

11. The system according to claim 3, wherein the by-pass channel is connected to an accumulator for accumulating a volume of hydraulic liquid.

12. The system according to claim 2, wherein the hydraulic deck compensator comprises a pair of hydraulic cylinders positioned at opposite sides of the firing line and being spaced apart to allow for a passage of the riser section in the firing line and between said pair of hydraulic cylinders.

13. The system according to claim 2, wherein the hydraulic deck compensator comprises a pair of hydraulic cylinders which are positioned at opposite sides of the firing line and being spaced apart to allow for a passage of the riser section in the firing line and between said pair of hydraulic cylinders.

14. An offshore drilling vessel comprising a floating hull subjected to heave motion, the hull comprising a moonpool further comprising the drilling system according to claim 1.

15. A method for drilling a subsea wellbore, comprising the steps of:

providing the offshore drilling system according to claim 1;

providing a heave compensation of the travelling block by the heave compensation system of the offshore drilling system; and providing a heave compensation of the mobile working deck by the hydraulic deck compensator which is hydraulically connected via the hydraulic conduit to the hydraulic sheave compensator of the heave compensation system, such that the deck compensator moves synchronously with the sheave compensator of the heave compensation system.

16. The method according to claim 15, further comprising the step of:

arranging a riser string between a subsea wellhead and the floating body, which riser string includes a slip joint, wherein in one mode the slip joint is unlocked, and wherein in another mode the slip joint is collapsed and locked, such that the heave compensation system is operative.

17. The method according to claim 16, wherein the floating body has a mobile working deck that rests on the riser, and wherein the working deck performs a compensated heave motion relative to the floating body in a heave motion compensation range as the slip joint is locked.

18. The method according to claim 15, further comprising the steps of:

adjusting a multiple fall arrangement of the tubular string main hoisting device; and opening or closing a by-pass channel of the hydraulic deck compensator in accordance with an adjustment of said multiple fall arrangement of the main hoisting device.

19. The method according to claim 18, wherein a suspension of the travelling block is adjusted from a 12-fall arrangement to an 8-fall arrangement.

20. The method according to claim 19, wherein the by-pass channel is opened in response to an adjustment of the main hoisting device from the 12-fall arrangement to the 8-fall arrangement.

* * * * *